US005294903A

United States Patent [19]

Bosch et al.

[11] Patent Number: 5,294,903

[45] Date of Patent: Mar. 15, 1994

[54] ELECTRIC SWITCH, IN PARTICULAR A LOAD SWITCH OR ELECTRIC CIRCUIT BREAKER

[75] Inventors: Hendrik A. Bosch, Hengelo; Soedjimat F. Darmohoetomo, Halle, both of Netherlands

[73] Assignee: Holec Systemen en Componenten B.V., Hengelo, Netherlands

[21] Appl. No.: 993,001

[22] Filed: Dec. 18, 1992

[30] Foreign Application Priority Data

Dec. 20, 1991 [NL] Netherlands ..... 9102154

[51] Int. Cl.[5] ..... H01H 9/00

[52] U.S. Cl. ..... 335/172; 335/21

[58] Field of Search ..... 335/23-25, 335/167-176, 21-22

[56] References Cited

U.S. PATENT DOCUMENTS 4,387,356 6/1983 Takemura et al. ..... 335/6

4,935,711 6/1990 Van der Scheer et al. ..... 335/131

FOREIGN PATENT DOCUMENTS 0322986 7/1989 European Pat. Off. .

2061682 6/1971 France .

*Primary Examiner*—Lincoln Donovan

*Attorney, Agent, or Firm*—Watson, Cole, Grindle & Watson

[57] ABSTRACT

An electric circuit breaker or load switch has at least one fixed contact, a movable contact and a spring system having a rigid arm and a leaf spring. The leaf spring is hinged to the arm to provide an arm-leaf spring assembly in the form of a toggle mechanism, having a first end hinged to a movably supported element bearing the movable contact, and a second end which is hingedly supported at a distance from and opposite the fixed contact. The second end, the first contact and the movable element are positioned such that the arm-leaf spring assembly in both the open and closed position of the contacts assumes a deflected position, by which the connection length of the switch is effectively reduced.

11 Claims, 5 Drawing Sheets

ELECTRIC SWITCH, IN PARTICULAR A LOAD SWITCH OR ELECTRIC CIRCUIT BREAKER

BACKGROUND OF THE INVENTION

The invention relates to an electric switch, in particular a load switch or power circuit breaker for low-voltage applications, comprising a housing, at least one pair of contacts consisting of a fixed and a movable contact which can assume a first and second position relative to the fixed contact; a spring system having a rigid arm and a leaf spring, which leaf spring is hinged by one end to the arm, in such a manner that an arm-leaf spring assembly in the form of a toggle mechanism with a first and second end is formed, in which the first end is hinged to a movably supported element which bears the movable contact, and in which the second end is disposed hingedly supported at a distance from and opposite the fixed contact; control means acting upon the arm-leaf spring assembly for taking the contacts into the first and/or second position, in which the leaf spring is released or tensioned; and latching means for locking the contacts in the first and/or second position.

A switch of this type, in which the movable contact is disposed in a linear, slidable manner by means of the movably supported element, is known from European Patent Application 0,322,986 A1.

Switching components for low-voltage applications must meet a number of requirements, inter alia with regard to the contact distance, i.e. the distance between the contacts in the open (non-conducting) state of the switch; the contact force, i.e. the force with which the contacts are held against each other in the closed (conducting) state of the switch; the contact opening speed; the short-circuiting capacity, i.e. the maximum permissible short-circuit current under the influence of which the contacts do not open by themselves; the contact wear, also called contact erosion; and if desired they must have provisions enabling them to separate from each other contacts which have become welded together.

The abovementioned requirements are for low-voltage applications, i.e. direct or alternating voltages in the range of about 42–750 V, depending on the nominal amperage of the switch, i.e. the maximum current intensity which the switch must be able to conduct continuously. Standardised amperages are specified in practice.

As in the case of electronic components, efforts are currently being made to achieve the smallest possible dimensions also in electrical components for low-voltage use. The reason for this is to accommodate as many components as possible in installation boxes or wiring boxes of standard dimensions, in order to improve the space filling factor, or to be able to utilise installation boxes or apparatus housings of reduced dimensions with the same number of components.

An obvious solution for reducing the switch length by reducing the length of the arm-leaf spring system in its extended state does little or nothing to help.

Shortening the leaf spring is possible only to a very limited degree, on account of the inadmissible increasing mechanical stress in the leaf spring material when the length is reduced. The selection of weaker spring material is limited, inter alia, because of the requirements concerning the contact force and the contact opening speed.

Shortening the arm of the arm-leaf spring assembly, if the arm is supported with one end rotatable in the housing and the leaf spring is coupled to the movable element, is also possible only to a limited degree because of the requirements concerning the contact distance. For, in order to achieve a desired contact distance in the case of an arm of reduced dimensions, this shorter arm must be turned from the extended position of the arm-leaf spring assembly through a greater angle than a longer arm. This greater angular rotation, in particular the time required for it, has an adverse effect on the contact opening speed of the switch.

Although in the opposite case, i.e. when the leaf spring is firmly clamped and the arm is coupled to the movable element, shortening of the arm does not have any direct influence on the contact opening speed, the greater angular rotation of the arm, which also occurs in that case, results in an undesirable greater friction force on the guiding of the movable element. Apart from the disadvantages of greater wear and mechanically narrower tolerances in the guiding of the slidable element, the greater friction force also has an adverse effect on the speed of movement of the slidable element.

A desired, effective reduction of the switch length can consequently not be achieved only by simply changing the dimensions of the arm-leaf spring assembly.

French Patent Application 2,061,682 discloses an electric switch comprising a toggle mechanism, spring means, a latching mechanism and control means. The toggle mechanism is made up of hingedly coupled arms, whereas the spring means comprise conventional compression and draw springs. The latching mechanism is designed in order to achieve a small force exerted by the toggle mechanism in its extended or nearly extended position on the control means. With regard to obtain an effective reduction of the switch length, while maintaining the requirements for a desired nominal amperage, switching speed, contact force, contact distance and acceptable mechanical loading, this switch construction offers no alternatives.

SUMMARY OF THE INVENTION

The object of the invention is to provide an electric switch, in particular a load switch or power circuit breaker for low-voltage applications, which switch meets the above mentioned requirements for a desired nominal amperage with a desired reliability and has reduced dimensions, in particular as regards the connection length, compared with known switches for the relevant application area. Connection length in this case is understood to mean the distance between the end faces of an approximately rectangular switch housing.

This object is achieved according to the invention in that the rotatably disposed second end of the arm-leaf spring assembly, the fixed contact and the movable element are positioned in such a manner relative to each other that the arm-leaf spring assembly both in the first and in the second position of the contacts assumes a relatively deflected position compared with the situation in which the arm and leaf spring are lying virtually in line with each other.

The invention is based on the insight that the requirements can be met as regards contact distance, contact force and contact opening speed using the known arm-leaf spring assembly by selecting a different operating area of the toggle mechanism formed by the arm and leaf spring. For, if the arm-leaf spring assembly is held in the deflected or bent position, an effective length reduction is achieved, compared with the known switch in which the arm and leaf spring are brought virtually in line with each other.

In the operating area according to the invention a relatively small angular rotation of, for example, the arm results in a relatively great displacement of the movable element, in this case the movable contact. In other words, in the switch according to the invention a desired contact distance is achieved in a relatively short period of time by the relatively small angular rotation of the arm-leaf spring assembly, which consequently means a relatively high contact opening speed. Furthermore, this effect is positively influenced through the fact that in the operating area of the arm-leaf spring assembly according to the invention a greater force acts on the movable element in the direction for opening of the contacts than in the virtually extended state of the arm-leaf spring assembly. Due to the fact that the dimensions and the material of the leaf spring do not need to be adapted, a desired contact force can further easily be met, corresponding to the known switch.

A further advantage of the invention lies in the fact that, in the operating area of the arm-leaf spring assembly of the switch according to the invention, shortening of the arm has, within wide limits, a negligible effect on the contact opening speed, unlike the known switch, as described above.

Consequently, in a further embodiment of the switch according to the invention, for further reducing the length of the switch, provision is made for an arm-leaf spring assembly of which the length of the arm, measured between the second end of the arm-leaf spring assembly and the engagement point with the leaf spring, is less than the length of the leaf spring, i.e. the length in the extended position of the leaf spring. In the preferred embodiment of the switch according to the invention said length of the arm is less than half the length of the leaf spring.

The force exerted by the arm-leaf spring assembly on the control means must in general be as small as possible, in order to minimise wear in hinge points and fastening points of the control means in the housing, so that control means and fastening points which are of as light design as possible will suffice, and in order to achieve unlocking of the switch with the lightest possible design of the means. An example of this last application could be a power circuit breaker in the form of an automatic switch, which must be capable of being switched off automatically on the occurrence of overload, short circuit and/or earth fault currents.

In order to reduce the force exerted by the arm-leaf spring assembly on the control means when the leaf spring is tensioned, in yet another embodiment the arm of the arm-leaf spring assembly is lengthened from the engagement point with the leaf spring, and the control means act upon the free end of the extended part of the arm (lever principle). In combination with a relatively short arm, the lever action thus produced does not lead to an undesirable enlargement of the dimensions of the switch.

A further reduction of the force exerted on the control means is achieved in an embodiment of the switch according to the invention in that the arm of the arm-leaf spring assembly is approximately V-shaped, and the leaf spring is hinged to the bend point of the arm. In this embodiment, in the tensioned state of the leaf spring, in which the latter forms an enclosed angle of the order of 30° with an imaginary connecting line between the rotatably disposed second end of the arm-leaf spring assembly and the fixed contact, by means of a suitable design, a force is exerted on the control means in the order of magnitude of the relatively small force acting transverse to the arm-leaf spring assembly in the situation in which the arm and the leaf spring lie virtually in line with each other, as in the case of the known switch.

In a preferred embodiment of the switch according to the invention the movably supported element is rotatably disposed in the housing. A rotatably supported element, unlike a slidable element as in the case of the known switch, not only has the advantage that the relative positioning of the arm-leaf spring assembly, the fixed contact and the movable element is facilitated according to the invention, but also has the advantage of a better defined, less tolerance-sensitive closing and opening of the contacts, because there is no misalignment, in other words scraping, in the slidably mounted element in the guide. This problem would require extra attention in the operating area of the switch mechanism according to the invention as a result of the relatively higher normal force (friction force) on the slidable element.

A further advantage of a rotatably supported element relates to the electrical connection of the contact of the switch fitted on the element in question. On account of the displacement of the relevant contact this connection must be flexible, and in practice the generally known litz wire is used for this. For high nominal amperages, i.e. currents of the order of magnitude of 40 or 63 amperes, this litz wire is still relatively stiff, on account of the required cross-section of 2 $mm^2$ or 5.5 $mm^2$, and produces a braking influence on the sliding of the movable element.

If now, according to a further embodiment of the switch according to the invention, the litz wire is arranged in such a manner that it extends along an imaginary line running from the contact on the rotatably supported element through the hinge point thereof, there is hardly any displacement of the litz wire, and thus a negligible influence on the contact opening speed, even in the case of a nominal current of 63A.

In a spatially advantageous and compact arrangement of the switch according to the invention, in particular provided with an element rotatably supported in the housing, the control means have a manually operable control knob which can assume a first and second position, and which is disposed in the housing at a distance from and opposite the arm-leaf spring assembly in the deflection direction thereof, and accessible from the outside, and a control arm of which one end is hinged to the control knob and of which another hook-shaped end in the first position of the control knob acts under additional spring force on the free end of the arm of the arm-leaf spring assembly, while by moving the control knob into the second position the leaf spring can be tensioned and the arm-leaf spring assembly is locked in the tensioned position through the hook-shaped end of the control arm acting thereon, and with an unlatching element disposed in the housing in the form of an unlatching arm which is hingedly supported at one end, and which in the tensioned state of the arm-leaf spring assembly acts on the control arm, in such a manner that by turning the unlatching arm the locking action of the control arm on the arm-leaf spring assembly can be released, while, by taking the control knob into the first position, the control arm can be brought into engagement again with the arm-leaf spring assembly.

In an embodiment of the switch according to the invention for moving the element at, for example, a predetermined speed, for example for closing the contacts at a certain speed or the phased switching of several pairs of contacts, for example a phase contact and a neutral contact, in which, for example, the neutral connection has to be made first, a retaining element is provided in the form of an approximately L-shaped retaining arm, which is disposed pivoting in such a manner about its bend point that under the influence of additional spring force it acts with one end on the movable element, for holding the element in the second position of the contacts against the spring force of the at least one leaf spring, while the control arm is provided with a stop which in the virtually tensioned state of the leaf spring acts on another end of the retaining arm, under the influence of which the retaining arm is turned in such a manner that the action of the one end on the movable element is removed and this element can be displaced at a predetermined speed under the influence of the tensioned leaf spring, for taking the contacts into the first position, and the stop is disposed in such a manner that, when the control arm is moved by means of the unlocking arm, the retaining arm is held in its rotated position, in such a manner that the movable element can be moved past the end of the retaining arm acting thereon, into the second position of the contacts.

In an embodiment of the switch according to the invention, in particular for use as a power circuit breaker, for remotely or automatically controlling the switch contacts under the influence of an overload, short-circuit and/or earth fault current, provision is made for means engaging on the free end of the unlatching arm for operation thereof by electrical, hydraulic and/or pneumatic control.

The switch according to the invention can advantageously be mounted in an effective way on one side of an essentially flat mounting frame, in such a manner that the assembled frame can be accommodated as a whole in the housing. If desired, an autonomously operating further switching mechanism can be fitted on the other side of the frame, and the control means can be combined or designed as one unit. In this manner it is possible to build up, for example, a four-pole switch, in which each switching mechanism operates two pairs of contacts, for switching the neutral and the phases of a 3-phase alternating current network, respectively. Such a mounting frame is known from European Patent Application 0,405,688 A1.

The invention is illustrated below with reference to figures of the preferred embodiment.

DETAILED DESCRIPTION OF THE EMBODIMENTS

Figure 1:
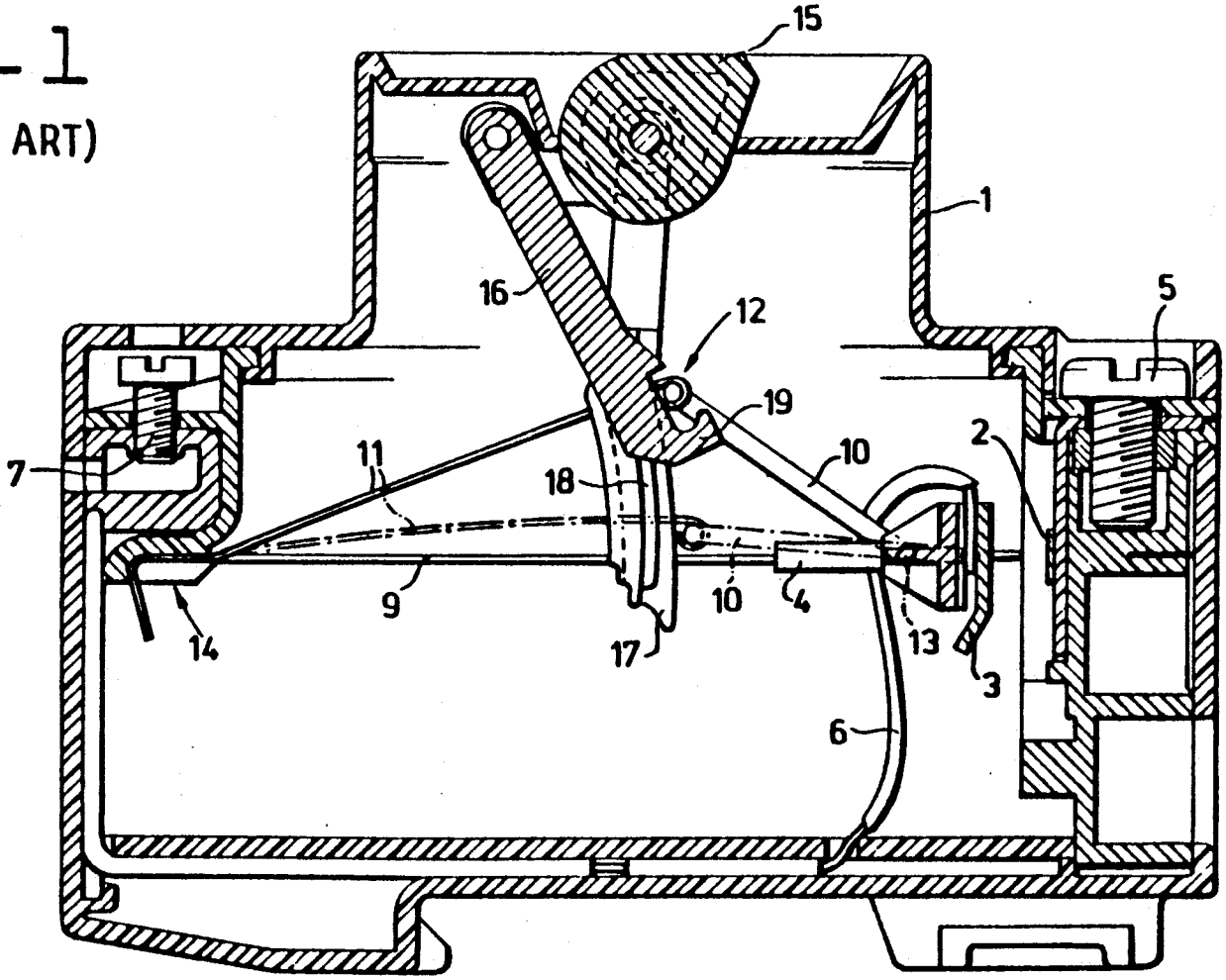
Fig-1 (PRIOR ART)
FIG. 1 shows schematically and in cross-section an embodiment of a prior art switch.

FIG. 1 shows schematically a cross-section of a switch known from European Patent Application 0,322,986 A1 with a housing 1 made of plastic. The switch comprises a pair of contacts in the form of a fixed contact 2 and a movable contact 3 which is disposed on a movably supported element 4 and is movable relative to the fixed contact 2. The fixed contact 2 is connected in an electrically conducting manner to a first terminal 5, while the movable contact 3 is connected by means of a flexible electrical connection in the form of a litz wire 6 to a second terminal 7 of the switch. The movable element 4 is fitted so that it slides in a guide frame 9.

The switching mechanism also comprises an arm-leaf spring assembly, made up of a rigid arm 10 and a leaf spring 11, the arm 10 and the leaf spring 11 being hingedly coupled at one end, indicated by the reference numeral 12, while a first end 13 of the arm-leaf spring assembly is hinged to the movable element 4, which first end in the embodiment shown is an end of the arm 10, while a second end 14 of the arm-leaf spring assembly is fitted so that it is hingedly supported at a distance from and opposite the fixed contact 2, in this case the other end of the leaf spring 11.

Control means are also provided in the form of a manually operable control knob 15, an arm 16 hinged thereto, and a guide 17 provided with a groove 18, in which a cam (not shown) fixed to the arm 16 is held mounted in such a way that it can be moved. The arm 16 has a hook-shaped free end 19 which can act upon the connecting point 12 of the arm 10 and the leaf spring 11.

Turning the control knob 15 to the left in the drawing causes the arm 16 to act with its free end 19 on the coupling point 12 of the arm-leaf spring assembly, as a result of which the movable element 4 is slid in the direction of the fixed contact 2. In the closed position of the contacts 2, 3, the arm 10 and the leaf spring 11 are virtually in line with each other, in other words in the position of equilibrium or in the dead centre of the toggle mechanism formed by the arm 10 and the leaf spring 11, as illustrated by broken lines. The contact force for holding the contacts 2, 3 in the closed position is supplied in this case by the then slightly curved leaf spring 11, which is locked in this position by the arm 16.

The contacts 2, 3 can be opened again by turning the control knob 15 to the right, viewed in the plane of the drawing. The result of this is that the arm 16, viewed in the plane of the drawing, is moved upwards, and the locking on the arm-leaf spring assembly is released, which assembly under the influence of the spring force of the leaf spring 11 assumes the deflected position shown by solid lines, in which the contacts 2, 3 are at a predetermined distance, the contact distance.

Figure 2:
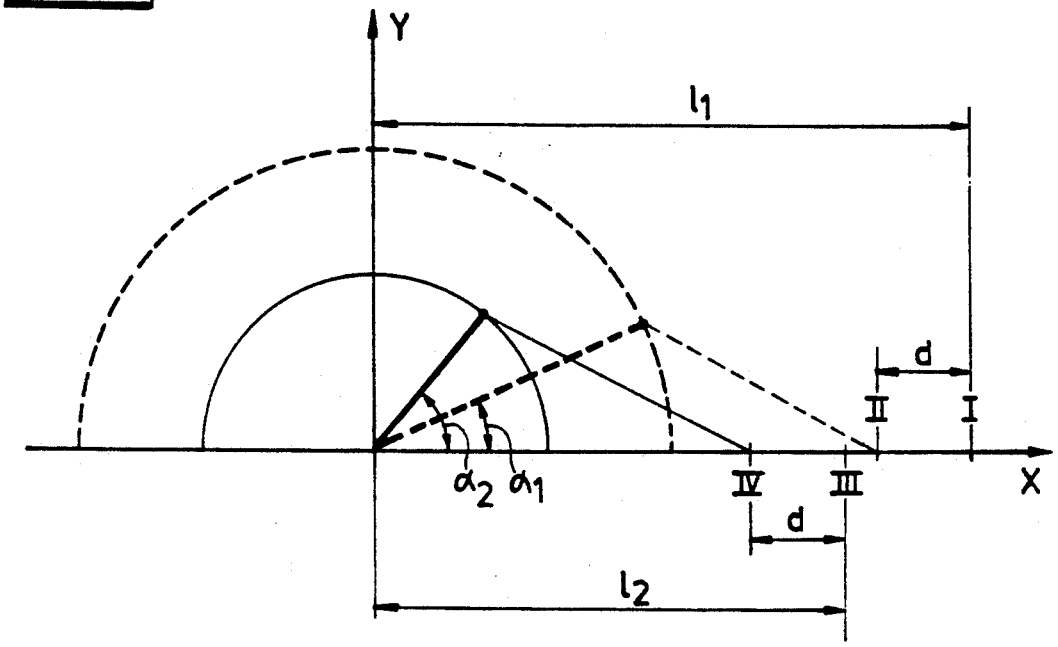
FIGS. 2 and 3 illustrate diagrammatically the various operating areas of the switch according to FIG. 1 and according to the invention, respectively.

FIG. 2 illustrates diagrammatically the influence of shortening the arm-leaf spring assembly in a switch of the type according to FIG. 1. In contrast to FIG. 1, it is assumed in FIG. 2 that the arm is supported rotatably at one end in the housing, while the leaf spring is connected to the element which is movable along the X-axis. Two situations are sketched in the figure, and for the sake of simplicity it is assumed that the arm-leaf spring assembly must be moved completely out of the extended position along the X-axis into the deflected position in the Y direction. The parameter selected is the contact distance d between the opened contacts.

The broken lines represent an arm-leaf spring assembly with an extended length $l_1$, in which the arm and the leaf spring are of equal length. For moving the movable contact out of the closed position, indicated by I, into the open position, indicated by II, the arm must be turned through an angle $\alpha_1$.

The situation in which the arm-leaf spring assembly has a shorter extended length $l_2$, as a result of shortening the arm, is shown by solid lines. For moving the movable contact out of the closed position, indicated by III, into the open position, indicated by IV, the arm must be turned through a greater angle $\alpha_2$, assuming the same contact distances d.

It can be seen clearly from this figure that shortening the arm means that a greater angular rotation is necessary to achieve a desired contact distance, while it will be clear that, with the same spring force of the leaf spring, turning the shorter arm will take relatively more time, which thus means a lower contact opening speed. Although the contact opening speed could be increased by selecting a stronger leaf spring, this would result in an undesirable increase in the force on the control means and the hinge points of the arm-leaf spring assembly, i.e. the mounting frame.

Figure 3:
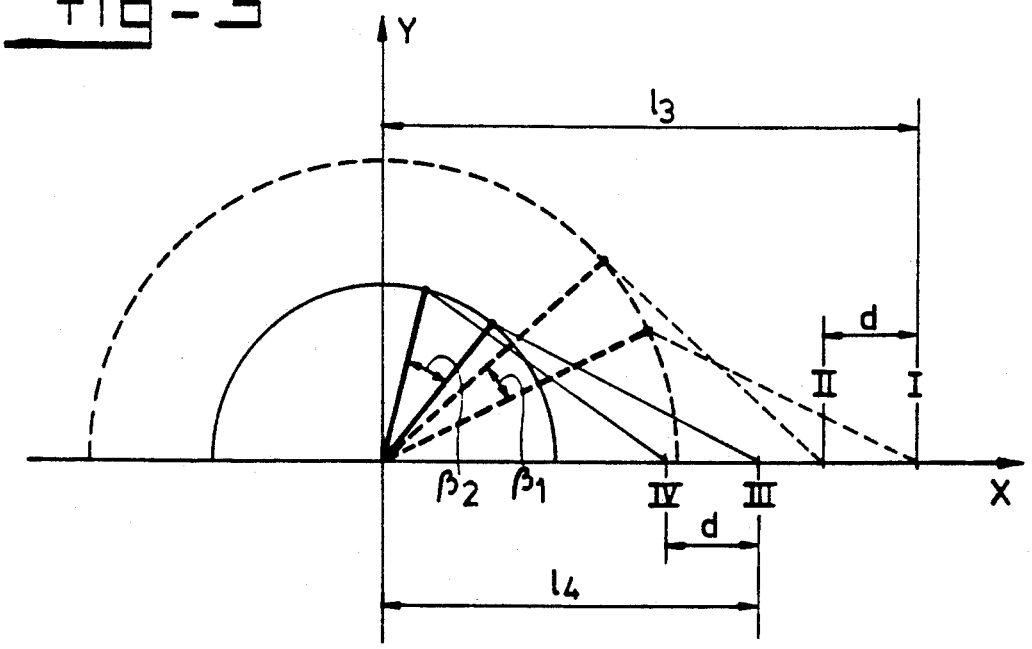

FIG. 3 shows diagrammatically the principle on which the invention is based, in which the arm-leaf spring assembly is no longer taken into the extended position, i.e. along the X-axis, but both in the opened and in the closed position of the contacts assumes a relatively deflected position in the Y direction.

According to FIG. 2, broken lines show an arm-leaf spring assembly in which the arm and the leaf spring have the same length. For moving the movable contact out of the closed position I into the open position II, the arm must be turned through an angle $\beta_1$. Comparison of FIGS. 2 and 3 immediately shows that, through altering the operating area of the arm-leaf spring assembly according to the invention, not only is the connection length $l_3$ shorter than the connection length $l_1$ of the known switch, but the angular rotation $\beta_1$ for moving the movable contact over the contact distance d in the switch according to the invention is also smaller than the angular rotation $\alpha_1$ in the known switch. Apart from an effective length reduction, this also means a higher contact opening speed in a leaf spring of equal dimensions and strength.

Solid lines in FIG. 3 show the situation in which the connection length of the switch is further reduced to a length $l_4$ by shortening the arm of the arm-leaf spring assembly. For moving the movable contact out of the closed position III into the open position IV over the contact distance d, the arm must be turned through an angle $\beta_2$. Comparison of FIGS. 2 and 3 shows that although the angle $\beta_2$ is approximately equal to the angle $\alpha_1$, the connection length $l_4$ is reduced to about two-thirds of the connection length $l_1$.

It will be clear that a different selection of the operating area and if desired a reduction of the dimensions of the arm-leaf spring assembly according to the invention results in an effective connection length reduction compared with the prior art, while maintaining the requirements concerning contact distance, contact force and contact opening speed.

Figure 4:
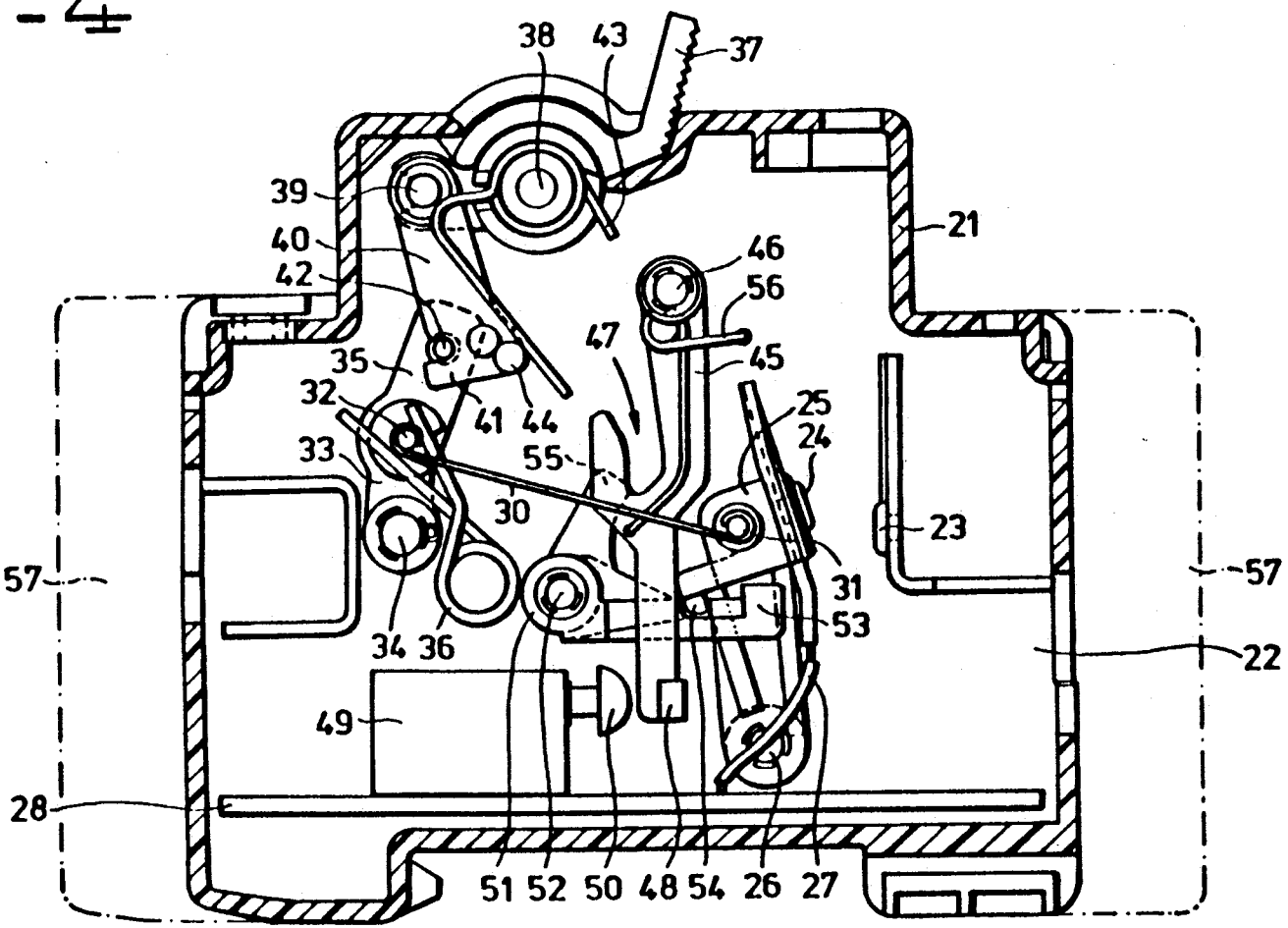
FIGS. 4 and 5 show schematically and in cross-section the preferred embodiment of the switch according to the invention, in various positions of the switching mechanism.

FIG. 4 shows the preferred embodiment of a switch according to the invention, in which only the parts necessary for understanding the invention are shown.

The switching mechanism is situated in a housing 21 of plastic, in which a mounting frame 22 is disposed. The fixed contact is indicated by the reference numeral 23, and the movable contact of the switch by numeral 24. The movable contact 24 is disposed on an arm-shaped element 25 which is supported in such a way that it rotates about a hinge point 26. A litz wire 27, which is arranged along an imaginary line running from the movable contact 24 through the hinge point 26, extends from the movable contact 24. The litz wire 27 is connected to a printed circuit board 28, on which further electrical and/or electronic components are situated. Instead of being connected to the printed circuit board 28, the litz wire 27 can also be directly connected to a terminal (not shown) of the switch, corresponding to FIG. 1. The fixed contact 23 is connected in an electrically conducting manner to a further terminal (not shown) of the switch, for example in the manner shown in FIG. 1.

The arm-leaf spring assembly is formed by a leaf spring 30, which is connected by means of a hinge point 31 to the element 25, and by means of a hinge point 32 to an arm 33 which is rotatable about a hinge point 34 at a distance from and opposite the fixed contact 23. A coil spring 36 acts on the hinge point 32 of the arm 33 and the leaf spring 30 in the direction for holding the arm 33 in the position shown. This is to prevent the contact distance between the contacts 23 and 24 from being able to vary undesirably through shocks and/or impacts. From the hinge point 32, the arm 33 is extended, indicated by the reference number 35, in the direction of a manually operable control knob 37. This control knob 37 is disposed so that it pivots about a hinge point 38 and by means of a hinge point 39 is connected to a control arm 40 provided with a hook-shaped end 41. The hook-shaped end 41 of the control arm 40 acts upon a cam 42 near the end of the extended part 35 of the arm 33. The control arm 40 is held in engagement with the cam 42 by means of a further coil spring 43 which is disposed around the hinge point 38 of the control knob and which engages on a stop 44 of the control arm, as shown.

An unlatching arm 45 is also disposed on the mounting frame 22, which arm can swing with one end about a hinge point 46. The unlatching arm 45 has a hook-shaped centre part 47 and a free end 48. Means 49, provided with a driven element 50 which can act upon the free end 48 of the unlatching arm 45, are disposed opposite the free end 48, for the purpose of turning the unlatching arm 45 to the left, viewed in the plane of the drawing.

In the preferred embodiment shown of the switch according to the invention provision is also made for an approximately L-shaped retaining arm 51, which is supported in the frame 22 in such a way that it rotates about a hinge point 52. With a hook-shaped end 53 the retaining arm 51 acts upon a stop 54 of the movable element 25, while the other end 55 points in the direction of the control knob 37. For taking the retaining arm 51 into the position shown, provision is made for a further coil spring 56 which can act with one end on the end 55 of the retaining arm 51.

The operation of the switch according to the invention can be understood as follows with reference to FIGS. 4 and 5.

Figure 5:
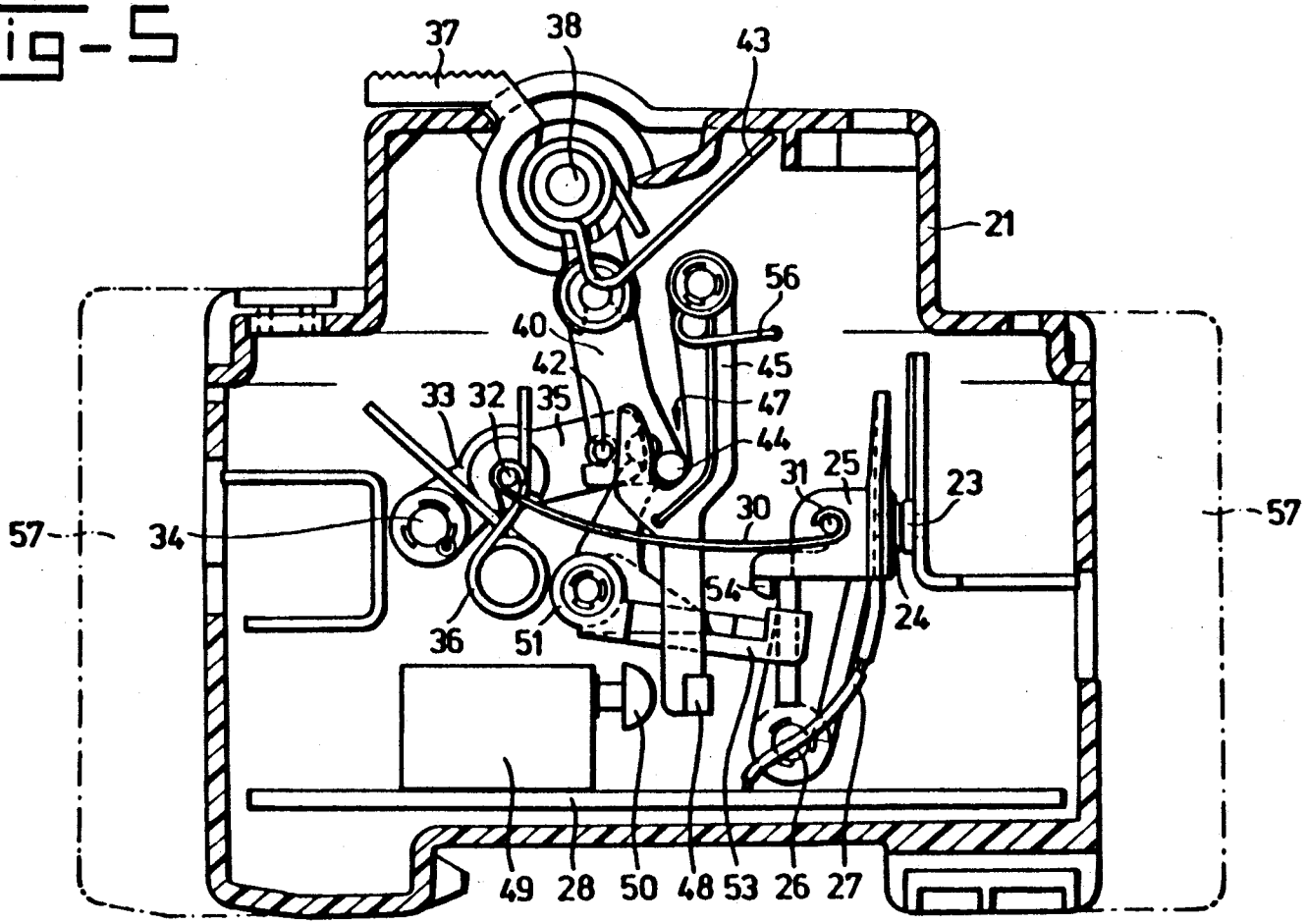

Moving the control knob 37 by hand out of the first position shown in FIG. 4 into the second position shown in FIG. 5 makes the control arm 40 move downwards, viewed in the plane of the drawing, in which case the hook-shaped end 41 by means of the cam 42 causes a rotation of the arm 33 to the right, viewed in the plane of the drawing.

Through this rotation, the leaf spring 30 is tensioned, because the movable element 25 is blocked in its illustrated position by means of the retaining arm 51. At the moment when the stop 44 of the control arm 40 goes into engagement with the end 55 of the retaining arm 51, said retaining arm 51 will be rotated to the right, viewed in the plane of the drawing, with the result that the action of the end 53 of the retaining arm 51 on the movable element 25 is released and, under the influence of the tensioning force built up in the leaf spring 30, it is rotated to the right, viewed in the plane of the drawing, in such a way that the contacts 23 and 24 touch each other, as shown in FIG. 5. The unlatching arm 45 is disposed in such a way that in this position the stop 44 of the control arm 40 acts upon the hook-shaped part 47 of the unlatching arm 45. The arm-leaf spring assembly is consequently locked in the tensioned state of the leaf spring 30 by means of the hook-shaped end 41 of the control arm 40 and the cam 42 on the extended part 35 of the arm 33.

It can be seen clearly from FIG. 5 that the arm 33 and the leaf spring 30 in the closed position of the switch assume a relatively deflected position compared with the position in which the arm 33 and the leaf spring 30 lie in line with each other, as in the case of the switch according to the prior art. In this deflected position the arm-leaf spring assembly exerts a force on the movable element 25 in the direction of opening of the contacts 23, 24. In addition to the smaller angular rotation, described above, for moving the movable contact 24 over a certain distance, this force has a favourable effect on the switching-off speed and for separating contacts which have become welded together, which will be explained in greater detail with reference to FIG. 6.

Swinging the unlatching arm 45 at its free end 48 to the left, viewed in the plane of the drawing, by means of the driven element 50 of the means 49 when the switch is in the closed position shown in FIG. 5, causes the control arm 40 to be moved to the left, viewed in the plane of the drawing, by means of its stop 44, with the result that the locking engagement of the hook-shaped end 41 with the cam 42 of the extended part 35 of the arm 33 is released, and the arm-leaf spring assembly can return to the position shown in FIG. 4, in which the contacts 23 and 24 are separated from each other, under the influence of the spring force stored up in the leaf spring 30. The stop 44 and the end 55 of the retaining arm 51 are positioned and dimensioned in such a way that the retaining arm 51 on rotation of the control arm 40 is held in the rotated position shown in FIG. 5, so that the movable element 25 can move with its stop 54 past the hook-shaped end 53 of the retaining arm 51.

If the control knob 37 is then returned to its first position, the control arm 40 is brought into engagement again with the arm-leaf spring assembly, and the retaining arm 51 is turned back into the position shown in FIG. 4 under the influence of the coil spring 56.

In a practical embodiment of the switch according to the invention, suitable for conducting a nominal current of 63A, the arm 33 in the closed (conducting) position forms an angle of approximately 30° with an imaginary connecting line between the hinge point 34 and the fixed contact 23. The length of the arm 33, measured between the hinge points 32 and 34, is approximately one quarter of the length of the leaf spring 30, measured between the hinge points 31 and 32. As shown in FIGS. 4 and 5, the arm 33 with its extended part 35 is approximately a V-shape, with the two parts being about the same length, and with an enclosed angle of about 160°.

Figure 6:
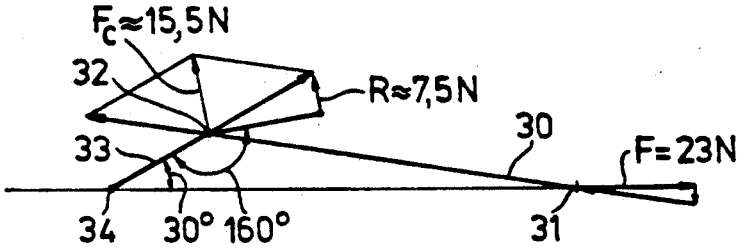
FIGS. 6 and 7 illustrate the forces exerted on the control means in the case of the switch according to the invention and according to the prior art, respectively.

FIG. 6 shows the forces diagram for this embodiment in the closed position of the switch, with a contact force F of 23 N being assumed. It can be seen from the diagram that in the hinge point 32, i.e. the connecting point of the arm 33 and the leaf spring 30 a force $F_c$ of the order of magnitude of 15.5 N is operative. By means of the extended part 35, this results in a reaction force R of around 7.5 N in the control arm 40.

Figure 7:
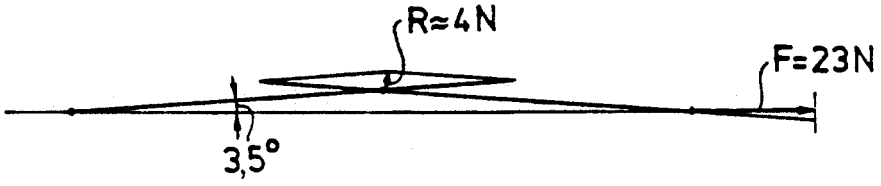

FIG. 7 shows for comparison the reaction force in the control arm in a switch constructed according to the prior art, in which the arm and the leaf spring are the same length, and in the closed position of the switch, the arm forms an angle of approximately 3.5° with the abovementioned connecting line between the fixed contact and the hinge point about which the arm can rotate. In the case of a contact force F which is also 23 N, a reaction force of around 4 N is then operative in the control arm.

It can be seen from this that the forces in the control arm, both in the case of the switch according to the prior art and in the case of the switch according to the invention, are of the same order of magnitude, but in the case of the latter about four times the initial force is operative for separating the contacts.

With the abovementioned practical embodiment of the switch according to the invention, compared with the known switches of this type, as illustrated, for example, in FIG. 1, a reduction of about 20 mm in the connection length is achieved. The contours of the known switches are indicated by broken lines 57 in FIGS. 4 and 5, for purposes of comparison.

Figure 8:
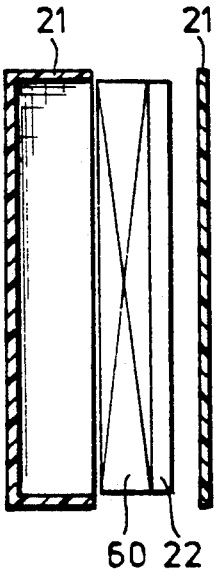
FIGS. 8 and 9 show schematically a mounting frame for use in the case of the switch according to the invention.
Figure 9:
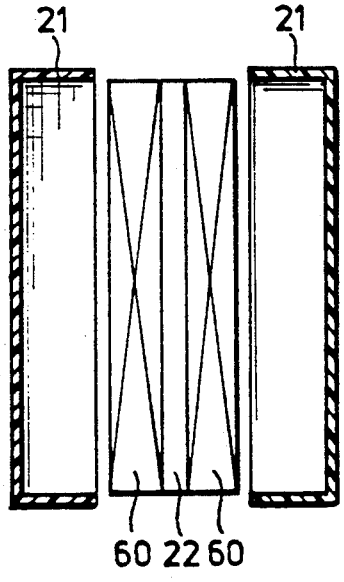

Finally, FIGS. 8 and 9 show diagrammatically a possible layout of the switch according to the invention, in which a frame 22 is mounted in the housing 21, while at one side of the frame, indicated by the reference number 60, and/or at the other side of the frame, indicated by the reference number 61, autonomously operating switches can be constructed in such a way that the shafts, cams and the like needed for supporting the components of the switching mechanism, and also the switch components themselves can be disposed in an effective manner on one side of the essentially flat mounting frame 22.

The means 49 shown in FIGS. 4 and 5 for operating the unlatching arm 45 can be electrically, hydraulically and/or pneumatically controlled means. In the case of electrically controlled means, they can be provided with means for automatic opening of the contacts electromagnetically, electrothermally and/or under the influence of earth fault currents, for example as described in European Patent Application 0,377,479 A1.

Although not explicitly illustrated above, the switch according to the invention can be provided with more than one pair of contacts, or an arm-leaf spring assembly connected thereto, which are interconnected for operation thereof by means of a single control knob. By, for example, combining two switch mechanisms, each with two pairs of contacts, in the manner illustrated in FIG. 9, a four-pole switch can be provided for use in low-voltage alternating current networks.

Although the invention is illustrated with reference to a power circuit breaker, i.e. a switch which is suitable for interrupting a power circuit in short-circuiting and/or overloading circumstances, it is possible, by leaving out the unlatching arm 45, the control means 49 and if necessary the retaining arm 51, to provide an embodiment as a load switch, i.e. a switch which need only interrupt the nominal current in a current circuit, or a current which is higher in percentage terms, according to FIG. 1. Like the switch in FIG. 1, the switching mechanism can be modified in such a way that, for example, the arm 33 acts upon the movable element 25, and the leaf spring 30 with one end fixed is hingedly supported by the frame 22.

We claim:

1. An electric switch, comprising a housing, at least one pair of contacts consisting of a fixed and a movable contact; a spring system, having a rigid arm and a leaf spring, which leaf spring is hinged by one end to the arm, in such a manner that an arm-leaf spring assembly in the form of a toggle mechanism with a first and second end is formed, in which the first end is hinged to a movably supported element which bears the movable contact, and in which the second end is disposed hingedly supported at a distance from and opposite the fixed contact; control means acting upon the arm-leaf spring assembly for taking the movable element into a first position, in which the leaf spring is released, and for taking the movable element into a second position, in which the leaf spring is tensioned; and latching means for locking the movable element in the first and second position, wherein the hingedly disposed second end of the arm-leaf spring assembly, the fixed contact and the movable element are positioned in such a manner relative to each other that the arm and leaf spring both in the first and in the second position of the movable element assume a relatively deflected position compared to an imaginary connecting line between the hingedly supported second end of the arm-leaf spring assembly and the fixed contact.

2. A switch according to claim 1, wherein the length of the arm, measured between the second end of the arm-leaf spring assembly and the engagement point with the leaf spring, is less than the length of the leaf spring.

3. A switch according to claim 2, wherein the arm of the arm-leaf spring assembly is lengthened from the engagement point with the leaf spring, and the control means act upon the free end of the extended part of the arm.

4. A switch according to claim 3, wherein the arm of the arm-leaf spring assembly is approximately V-shaped, and the leaf spring is hinged to the bend point of the arm.

5. A switch according to claim 1, wherein in the tensioned state of the leaf spring, the arm forms an enclosed angle of the order of 30° with an imaginary connecting line between the hingedly disposed second end of the arm-leaf spring assembly and the fixed contact.

6. A switch according to claim 1, wherein the movably supported element is rotatably disposed in the housing.

7. A switch according to claim 6, wherein a litz wire is connected to the movable contact in an electrically conducting manner, which litz wire is arranged in such a manner that it extends along an imaginary line running from the contact through the hinge point of the movable element.

8. A switch according to claim 6, wherein the control means have a manually operable control knob which can assume a first and second position, and which is disposed in the housing at a distance from and opposite the arm-leaf spring assembly in the deflection direction thereof, and accessible from the outside, and a control arm of which one end is hinged to the control knob and of which another hook-shaped end in the first position of the control knob acts under additional spring force on the free end of the arm of the arm-leaf spring assembly, while by moving the control knob into the second position the leaf spring can be tensioned and the arm-leaf spring assembly is locked in the tensioned position through the hook-shaped end of the control arm acting thereon, and with an unlatching element disposed in the housing in the form of an unlatching arm which is hingedly supported at one end, and which in the tensioned state of the arm-leaf spring assembly acts on the control arm, in such a manner that by turning the unlatching arm the locking action of the control arm on the arm-leaf spring assembly can be released while, by taking the control knob into the first position, the control arm can be brought into engagement again with the arm-leaf spring assembly.

9. A switch according to claim 8, comprising a retaining element, in the form of an approximately L-shaped retaining arm, which is disposed pivoting in such a manner about its bend point that under the influence of additional spring force it acts with one end on the movable element, for holding the element in the second position of the contacts against the spring force of the at least one leaf spring, while the control arm is provided with a stop which in the virtually tensioned state of the leaf spring acts on another end of the retaining arm, under the influence of which the retaining arm is turned in such a manner that the action of the one end on the movable element is removed and this element can be displaced at a predetermined speed under the influence of the tensioned leaf spring, for taking the contacts into the first position, and the stop is disposed in such a manner that, when the control arm is moved by means of the unlatching arm the retaining arm is held in its rotated position, in such a manner that the movable element can be moved past the end of the retaining arm acting thereon, into the second position of the contacts.

10. A switch according to claim 8, provided with means engaging on the free end of the unlatching arm, for operation of the unlatching arm by electrical, hydraulic and/or pneumatic control.

11. A switch according to claim 1, comprising an essentially flat mounting frame, on one or both sides of which supporting means can be provided for supporting the arm-leaf spring assembly, the movable element and the control means, and in which autonomously operating switching mechanisms can be fitted effectively on one or both sides.

* * * * *